US008938177B2

(12) United States Patent
Imai

(10) Patent No.: US 8,938,177 B2
(45) Date of Patent: Jan. 20, 2015

(54) TILT PANEL APPARATUS AND ELECTRONIC DEVICE

(75) Inventor: Daisuke Imai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 460 days.

(21) Appl. No.: 12/840,412

(22) Filed: Jul. 21, 2010

(65) Prior Publication Data

US 2011/0019347 A1 Jan. 27, 2011

(30) Foreign Application Priority Data

Jul. 23, 2009 (JP) ..... 2009-172033

(51) Int. Cl.
*G03G 15/00* (2006.01)
*G03G 21/16* (2006.01)

(52) U.S. Cl.
CPC ..... *G03G 21/1628* (2013.01); *G03G 15/5016* (2013.01); *G03G 2221/1687* (2013.01)
USPC ..... 399/81

(58) Field of Classification Search
CPC ..... G03G 15/5016
USPC ..... 399/81
See application file for complete search history.

(56) References Cited

U.S. PATENT DOCUMENTS

| | | | | |
|---|---|---|---|---|
| 7,387,503 | B2 | 6/2008 | Toda et al. | |
| 7,786,613 | B2 | 8/2010 | Hamaoka et al. | |
| 2005/0128688 | A1* | 6/2005 | Miura | 361/679 |
| 2006/0219852 | A1 | 10/2006 | Kawai et al. | |
| 2008/0232050 | A1* | 9/2008 | Muraki | 361/681 |
| 2009/0103251 | A1* | 4/2009 | Suzuki et al. | 361/679.02 |

FOREIGN PATENT DOCUMENTS

| | | |
|---|---|---|
| CN | 1942072 | 4/2007 |
| CN | 101008387 | 8/2007 |
| JP | 11-321021 | 11/1999 |
| JP | 2002-160421 | 6/2002 |
| JP | 2006-259205 | 9/2006 |
| JP | 2009-105557 | 5/2009 |

* cited by examiner

*Primary Examiner* — David Gray
*Assistant Examiner* — Andrew V Do
(74) *Attorney, Agent, or Firm* — Workman Nydegger

(57) ABSTRACT

A tilt panel apparatus includes a tilt panel capable of pivoting between a first orientation and a second orientation, and an apparatus main body that supports the tilt panel in a pivotable state. The tilt panel has an external housing surface around the pivot center of the tilt panel, the external housing surface being exposed on the outer side of an apparatus when the tilt panel is in the first orientation and entering into a gap formed between the tilt panel and the apparatus main body as the tilt panel pivots from the first orientation toward the second orientation; and a stepped portion is formed in the apparatus main body adjacent to an edge portion that forms the opening of the gap, the stepped portion being a step higher than the edge portion.

12 Claims, 10 Drawing Sheets

TILT PANEL APPARATUS AND ELECTRONIC DEVICE

BACKGROUND

1. Technical Field

The present invention relates to a tilt panel apparatus provided with a tilt panel that is capable of pivoting between a first orientation and a second orientation and an apparatus main body that supports the tilt panel in a pivotable state, and to an electronic device provided with the tilt panel apparatus.

2. Related Art

In electronic devices, an information display unit that displays various information (configured of, for example, a liquid-crystal display unit) and an operation setting unit including operation buttons, a power button, and so on for carrying out various types of operation settings are provided in a tilt panel, and through a tilt mechanism (pivot regulation apparatus), can maintain a desired orientation in which a user can visually confirm information, make operation settings, and so on with ease (for example, see JP-A-2009-105557).

With the operation apparatus disclosed in the stated JP-A-2009-105557, the operation panel member (the tilt panel) is provided so as to pivot between a first orientation, in which the operation panel member lays flush against the apparatus main body, and a second orientation, in which the operation panel member is erect relative to the apparatus main body.

Here, a gap is provided between the external housing around the pivot center on which the operation panel member pivots and the apparatus main body, and thus when the operation panel member pivots from the first orientation toward the second orientation, the external housing around the pivot center on which the operation panel member pivots enters into the apparatus (that is, into the stated gap).

Accordingly, there is a risk that when a user pivots the operational panel member while his/her finger is positioned upon the surface of the external housing around the pivot center on which the operation panel member pivots, the pad of the finger that is positioned upon the stated surface of the external housing will enter into the gap along with the external housing.

SUMMARY

An advantage of some aspects of the invention is to prevent, when tilting (pivoting) a tilt panel supported on an apparatus main body so as to be pivotable between a first orientation and a second orientation while a finger is positioned on the external housing of the tilt panel, the unrestricted entry of finger positioned on the external housing into a gap formed between the external housing and the apparatus main body.

A first aspect of the invention is a tilt panel apparatus including a tilt panel capable of pivoting between a first orientation and a second orientation, and an apparatus main body that supports the tilt panel in a pivotable state; the tilt panel includes an external housing surface around the pivot center of the tilt panel, the external housing surface being exposed on the outer side of an apparatus when the tilt panel is in the first orientation and entering into a gap formed between the tilt panel and the apparatus main body as the tilt panel pivots from the first orientation toward the second orientation; and a stepped portion is formed in the apparatus main body adjacent to an edge portion that forms the opening of the gap, the stepped portion being a step higher than the edge portion.

According to this aspect, when the tilt panel is pivoted from the first orientation toward the second orientation in a state in which a finger is applied to the external housing surface around the pivot center of the tilt panel, the finger applied to the external housing surface makes contact with an elevated portion of the stepped portion before the pad of the finger applied to the external housing surface enters in an unrestricted manner into the gap along with the external housing surface. Accordingly, the unrestricted entry of the pad of the finger applied to the external housing surface into the gap can be prevented.

A second aspect of the invention is the tilt panel apparatus further including an orientation holding member that holds the orientation of the tilt panel; the orientation holding member includes, on a free end of the tilt panel, a release button that releases a state in which the orientation of the tilt panel is held; and the stepped portion is provided so as to be aligned with the position, in the direction parallel to the pivot center line of the tilt panel, in which the release button is disposed.

When the release button that releases the state in which the orientation of the tilt panel is held is provided on the free end of the tilt panel, it is easy to match the location in which the release button is provided to the location where a user applies his/her finger in order to pivot the tilt panel. Accordingly, there is a risk that the pad of the finger that is applied to the side opposite to the area where the release button is disposed (the free end side), or in other words, the external housing surface on the base side end, will enter into the stated gap. However, because the stepped portion is provided so as to be aligned with the location in which the release button is provided, the entry of the pad of the finger applied to the external housing surface into the gap can be prevented with certainty.

A third aspect of the invention is, in the tilt panel apparatus according to the first or second aspect, an inclined surface that slants from an apex portion of the stepped portion toward a position that is lower than the apex portion, in the direction moving away from the external housing surface, is formed.

According to this aspect, the inclined surface that slants from the apex portion of the stepped portion toward a position that is lower than the apex portion, in the direction moving away from the external housing surface, is formed, and thus the finger that makes contact with the stepped portion is guided away from the gap by the inclined surface. Accordingly, the entry of the pad of the finger applied to the external housing surface into the gap can be prevented with certainty.

A fourth aspect of the invention is a tilt panel apparatus including a tilt panel capable of pivoting between a first orientation and a second orientation, and an apparatus main body that supports the tilt panel in a pivotable state; the tilt panel includes an external housing surface around the pivot center of the tilt panel, the external housing surface being exposed on the outer side of an apparatus when the tilt panel is in the first orientation and entering into a gap formed between the tilt panel and the apparatus main body as the tilt panel pivots from the first orientation toward the second orientation; and a finger contact portion is provided in the apparatus main body adjacent to an edge portion that forms the opening of the gap, the finger contact portion securing a distance between the pad of a finger and the opening by making contact with the tip of the finger when the tilt panel is pivoted from the first orientation toward the second orientation in a state in which the finger is applied to the external housing surface.

According to this aspect, when the tilt panel is pivoted from the first orientation toward the second orientation in a state in which a finger is applied to the external housing surface around the pivot center of the tilt panel, the tip of the finger makes contact with the finger contact portion, and a distance is secured between the pad of the finger and the opening; therefore, the entry of the pad of the finger applied to the external housing surface into the gap can be prevented.

A fifth aspect of the invention is a tilt panel apparatus including a tilt panel capable of pivoting between a first orientation and a second orientation, and an apparatus main body that supports the tilt panel in a pivotable state; the tilt panel includes an external housing surface around the pivot center of the tilt panel, the external housing surface being exposed on the outer side of an apparatus when the tilt panel is in the first orientation and entering into a gap formed between the tilt panel and the apparatus main body as the tilt panel pivots from the first orientation toward the second orientation; and a regulation portion is provided in the apparatus main body adjacent to an edge portion that forms the opening of the gap, the regulation portion regulating the movement of a finger by making contact with the tip of the finger when the tilt panel is pivoted from the first orientation toward the second orientation in a state in which the finger is applied to the external housing surface.

According to this aspect, when the external housing surface enters into the apparatus as the tilt panel pivots, the finger applied to the external housing surface makes contact with the regulation portion, thus preventing the further movement of the finger. Accordingly, the unrestricted entry of the pad of the finger into the gap can be prevented.

An electronic device according to a sixth aspect of the invention includes the tilt panel apparatus according to the first through fifth aspects. According to this aspect, an electronic device can achieve the same effects as the aforementioned first through fifth aspects.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
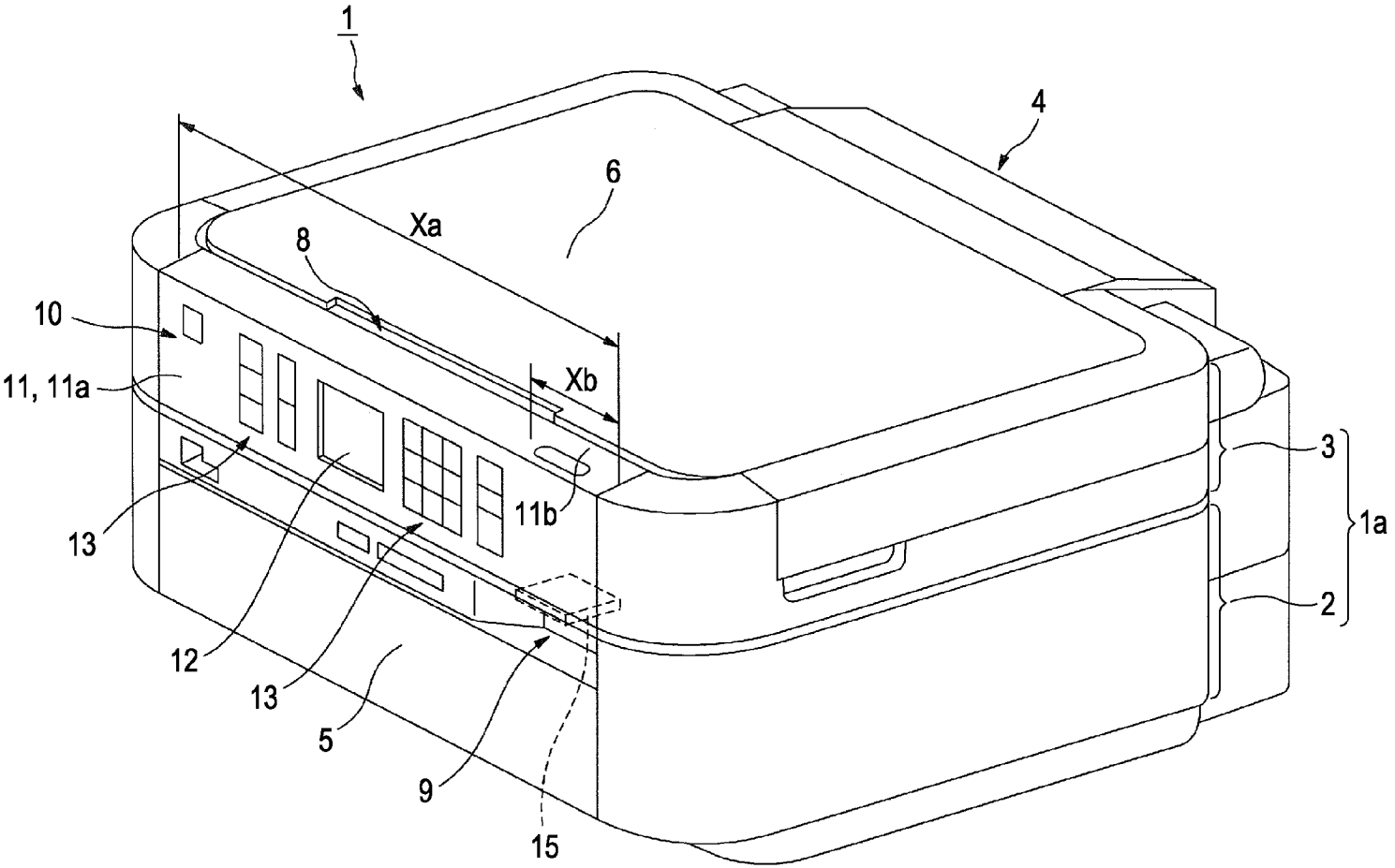
FIG. 1 is an external perspective view of an ink jet complex machine according to the invention.
Figure 2:
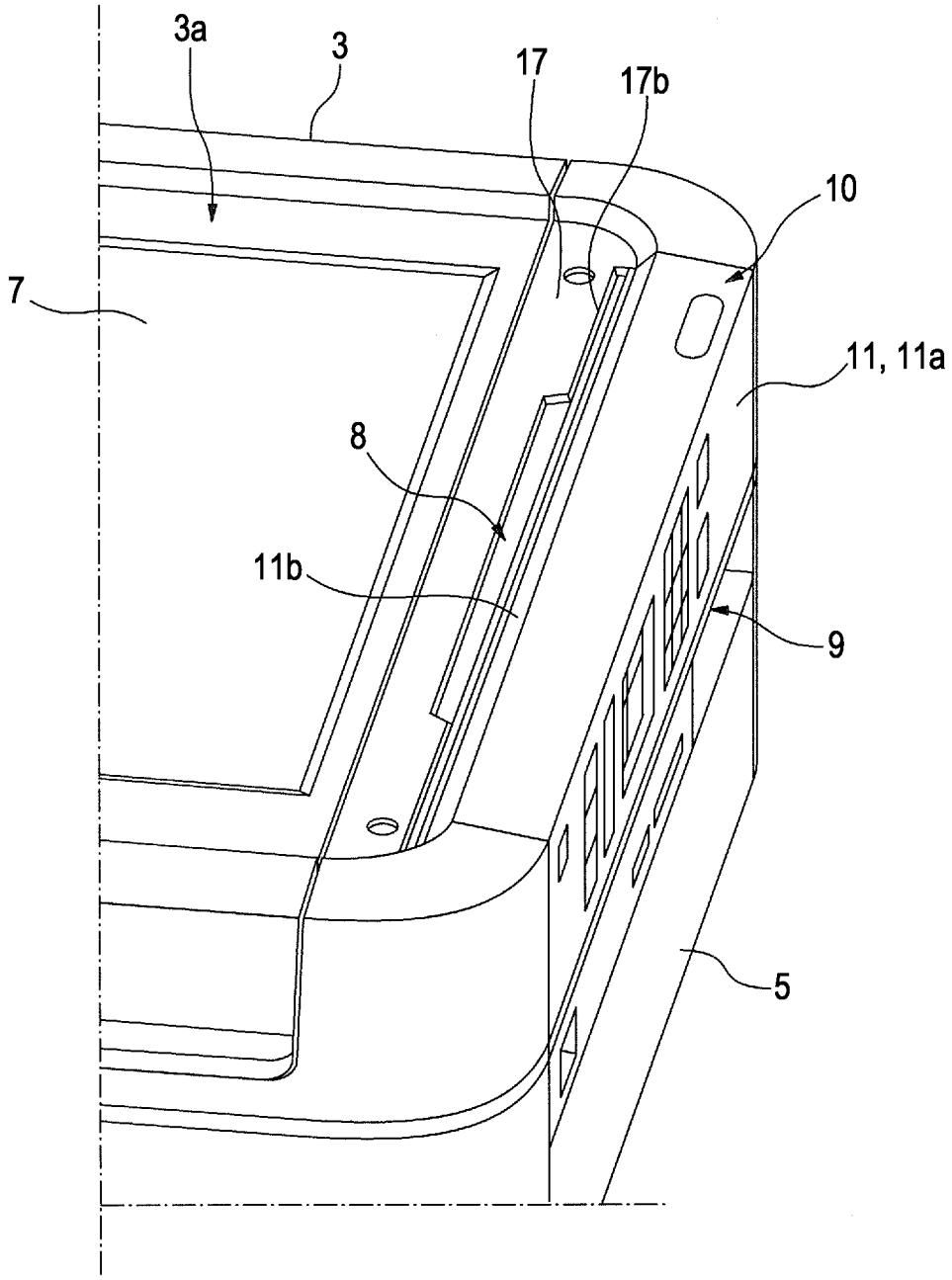
FIG. 2 is a perspective view illustrating the primary elements of an ink jet complex machine according to the invention in a state in which a document plate cover has been removed therefrom.
Figure 3:
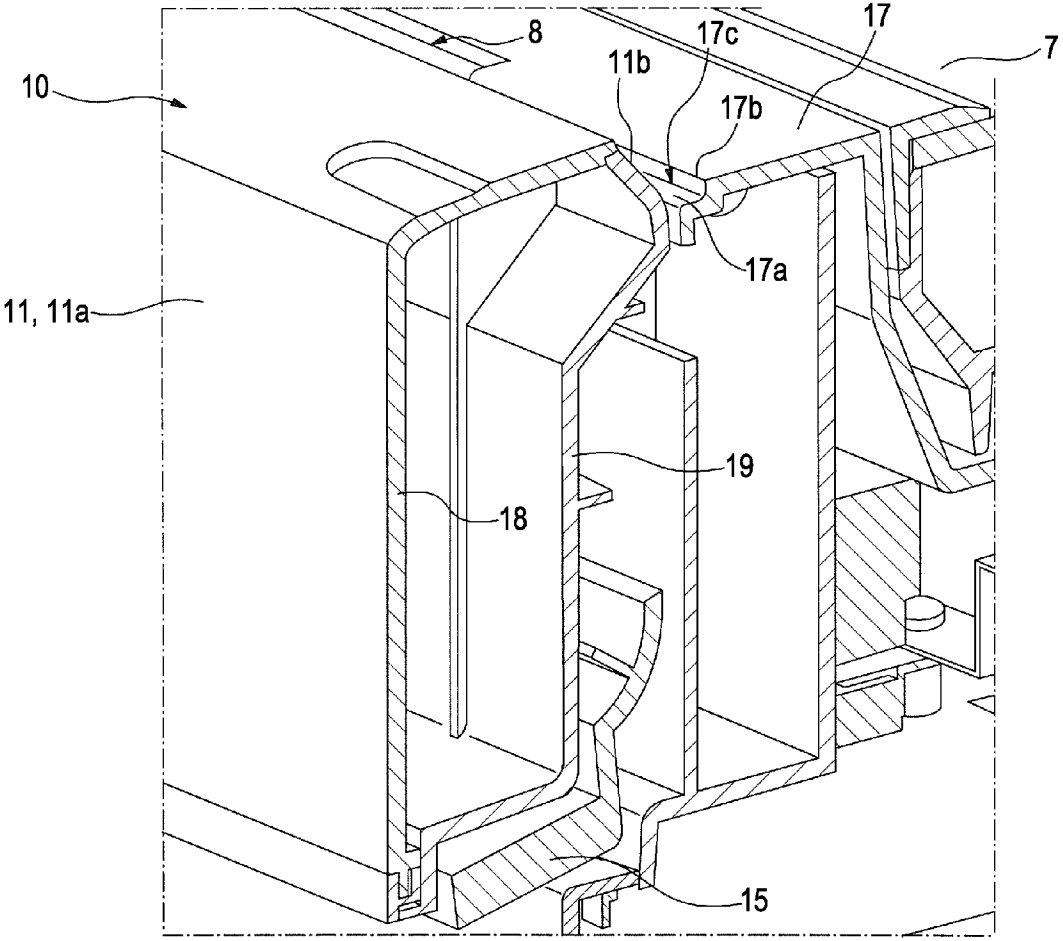
FIG. 3 is a cross-sectional perspective view illustrating a state in which a tilt panel of a tilt panel apparatus according to the invention is in a first orientation (a stored state).
Figure 4:
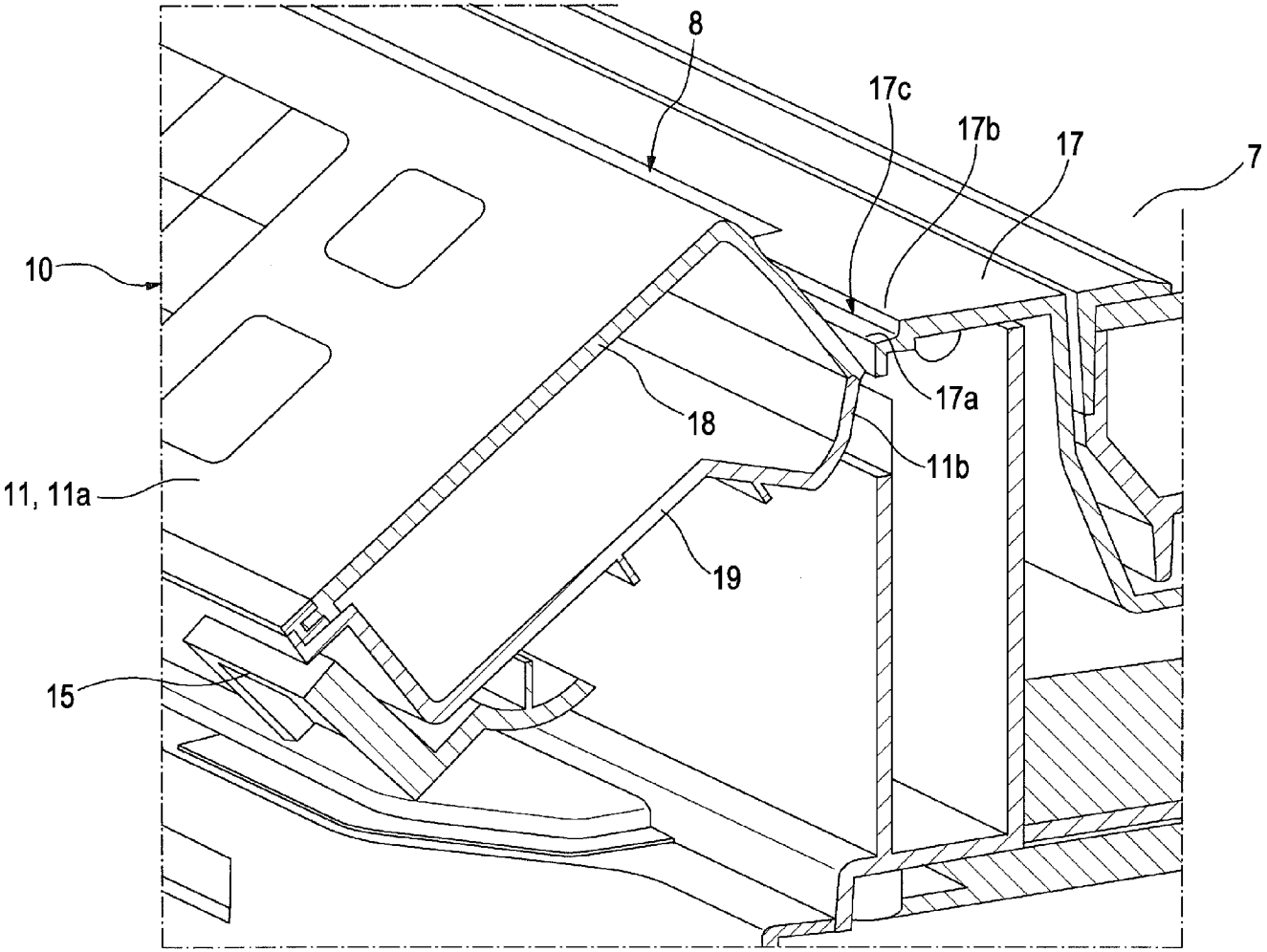
FIG. 4 is a cross-sectional perspective view illustrating a state in which the tilt panel of the tilt panel apparatus according to the invention is in a tilted state.

Hereinafter, embodiments of the invention will be described with reference to FIGS. 1 through 10. FIG. 1 is an external perspective view of an ink jet complex machine 1, serving as an example of an electronic device according to the invention; FIG. 2 is a perspective view illustrating the primary elements of the ink jet complex machine 1 in a state in which a document plate cover 6 has been removed therefrom; FIG. 3 is a cross-sectional perspective view illustrating a state in which a tilt panel 11 of a tilt panel apparatus 10 according to the invention is in a first orientation (a stored state); and FIG. 4 is a cross-sectional perspective view illustrating the same tilt panel in a tilted state.

Figure 5:
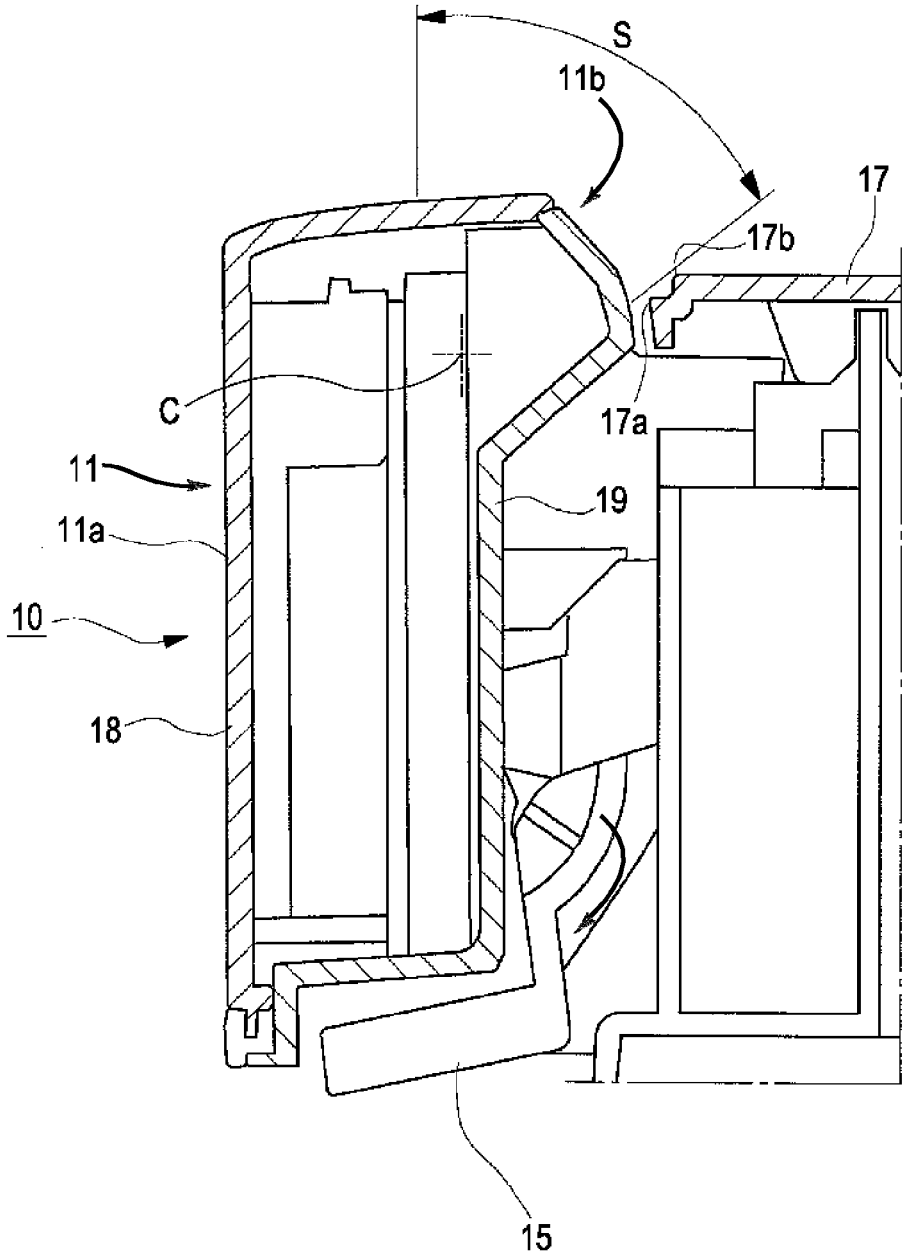
FIG. 5 is a cross-sectional view illustrating a state in which the tilt panel of the tilt panel apparatus according to the invention is in the first orientation (the stored state).
Figure 6:
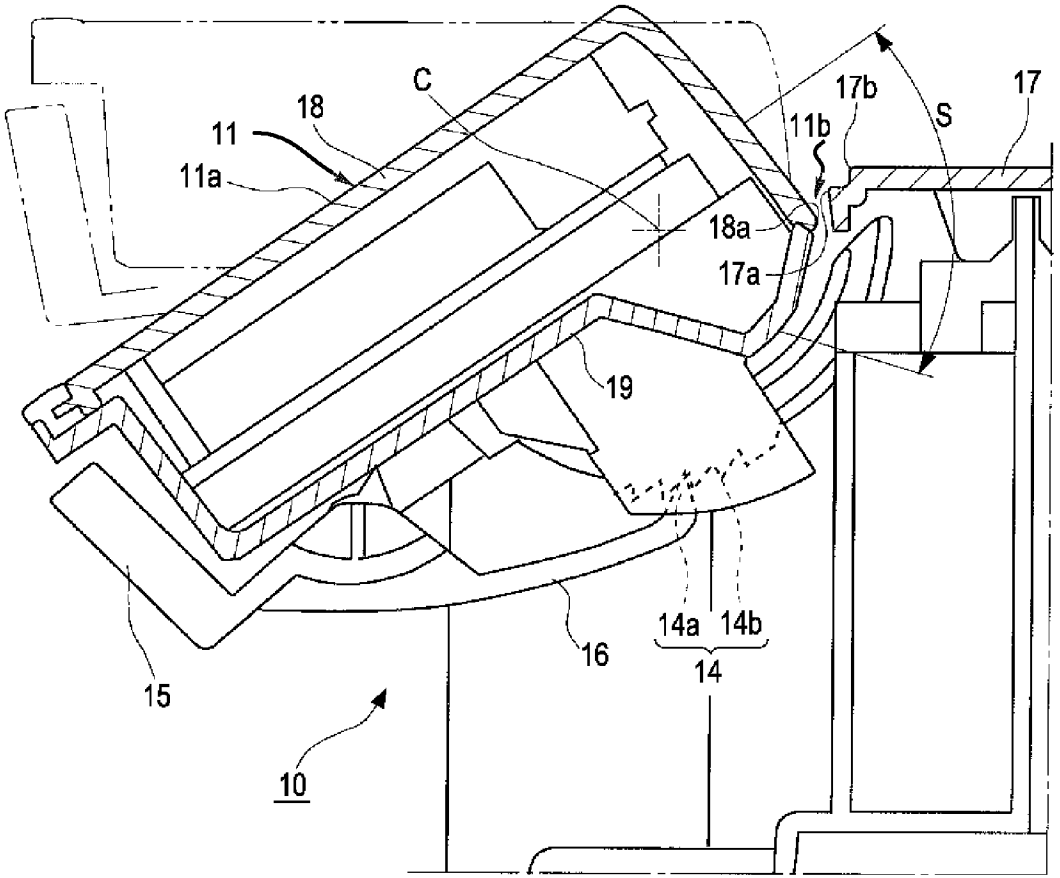
FIG. 6 is a cross-sectional view illustrating a state in which the tilt panel of the tilt panel apparatus according to the invention is in the tilted state.
Figure 7:
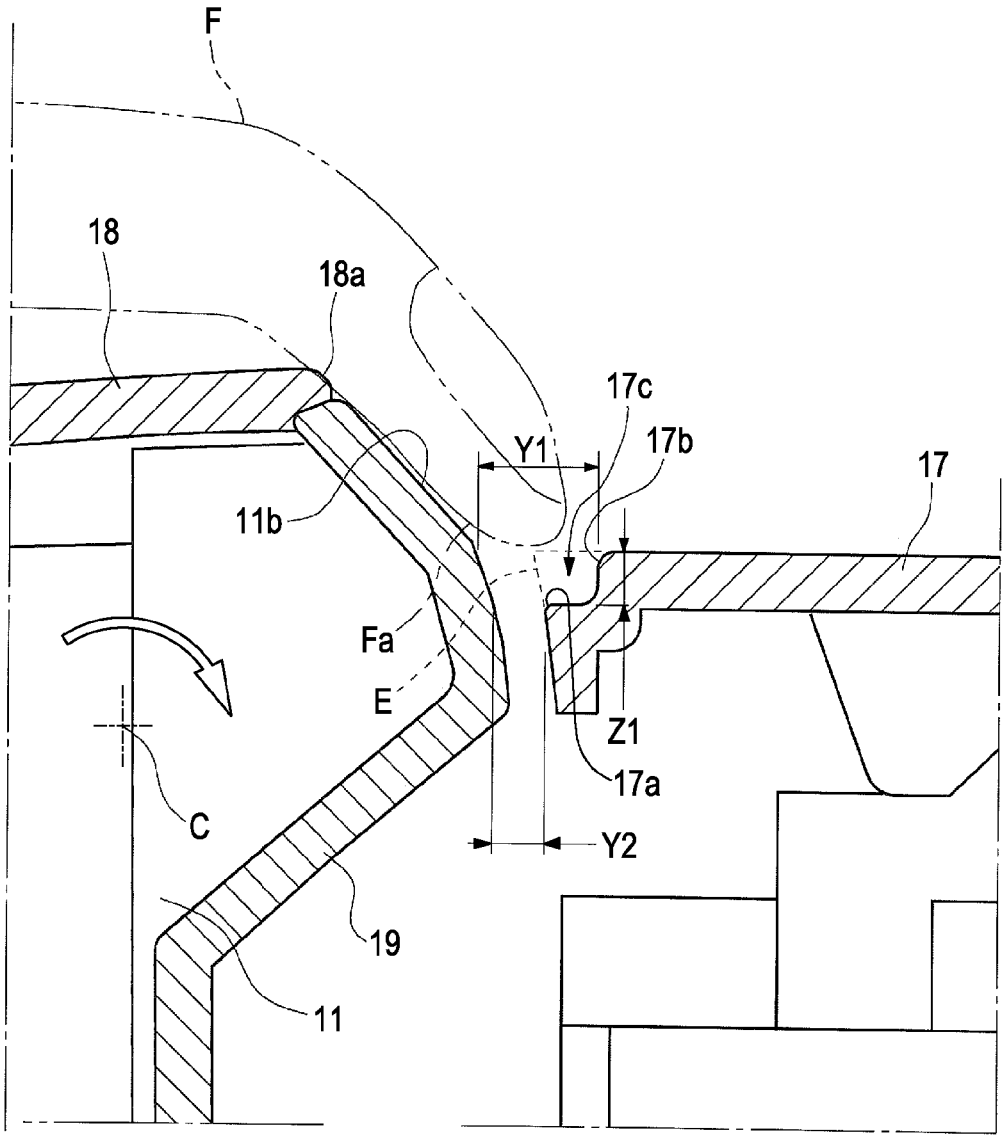
FIG. 7 is a cross-sectional view of primary elements in a state in which the tilt panel of the tilt panel apparatus according to the invention is in the first orientation (the stored state).
Figure 8:
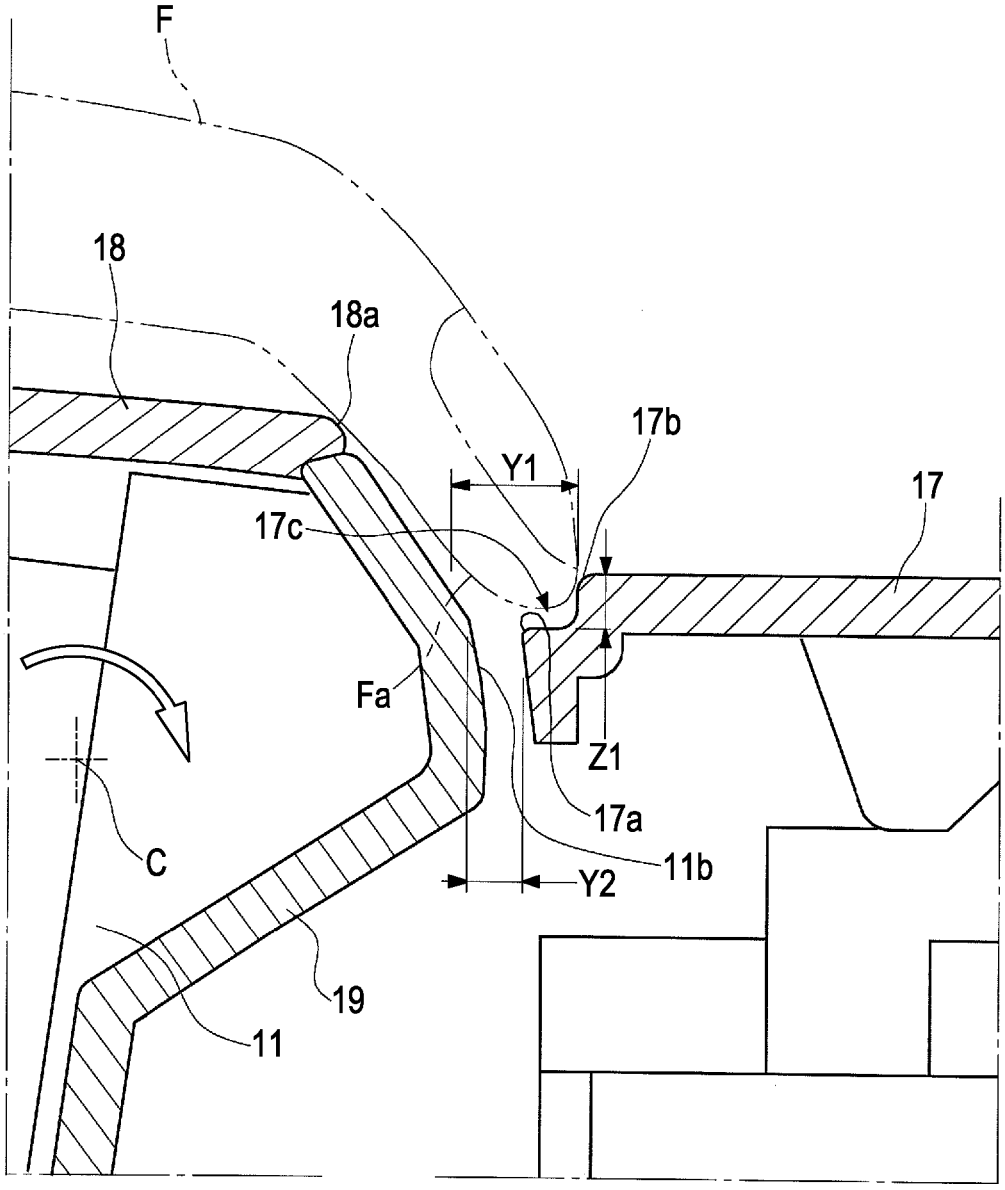
FIG. 8 is a cross-sectional view of the primary elements in a state in which the tilt panel of the tilt panel apparatus according to the invention is in the tilted state.
Figure 9:
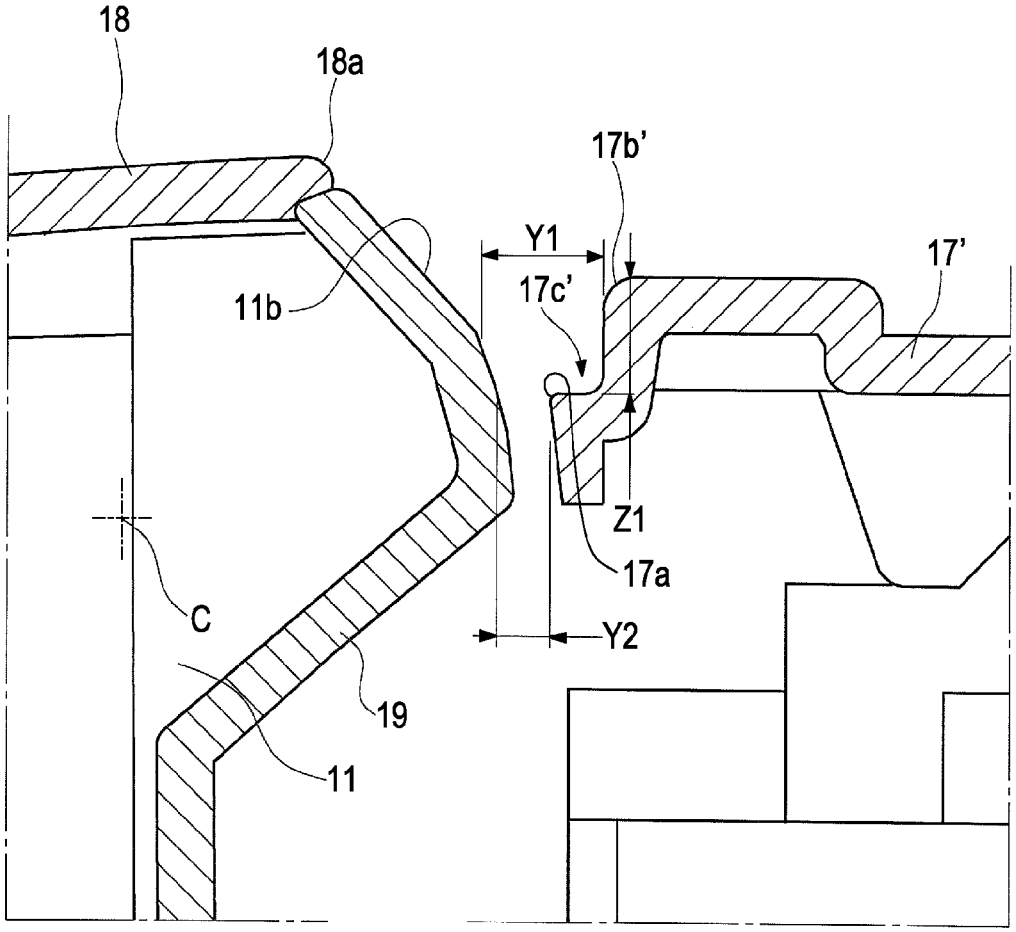
FIG. 9 is a cross-sectional view of primary elements of a tilt panel apparatus according to another embodiment of the invention.
Figure 10:
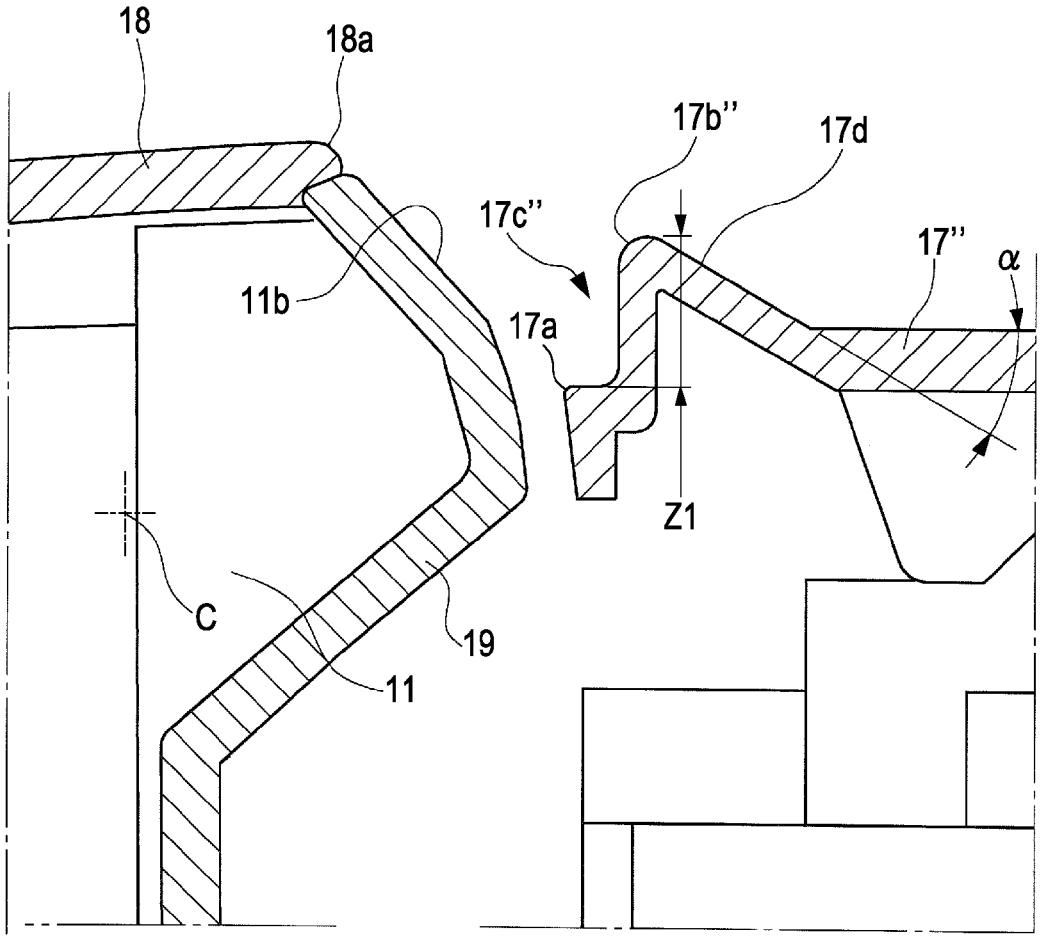
FIG. 10 is a cross-sectional view of primary elements of a tilt panel apparatus according to more another embodiment of the invention.

Meanwhile, FIG. 5 is a cross-sectional view illustrating the tilt panel 11 in the first orientation; FIG. 6 is a cross-sectional view illustrating the same tilt panel in a tilted state; FIG. 7 is a cross-sectional view of the primary elements (an enlarged view of the primary elements) illustrating a state in which the tilt panel 11 in the first orientation (the stored state); and FIG. 8 is a cross-sectional view of the primary elements (an enlarged view of the primary elements) of the tilt panel 11 illustrating a tilted state. Furthermore, FIGS. 9 and 10 are cross-sectional views of the primary elements illustrating a tilt panel apparatus according to another embodiment of the invention.

As shown in FIG. 1, the ink jet complex machine 1 is what is known as complex machine, in which an apparatus main body 1*a* is configured of a scanner mechanism portion 3, which reads an image, provided above an ink jet printer mechanism portion 2, which executes recording onto a recording target medium.

A paper feed portion 4, in which recording paper is set, is provided on the rear side of the apparatus main body 1*a*, and recording paper set in the paper feed portion 4 is fed one sheet at a time to the ink jet printer mechanism portion 2, after which recording is executed. The recording paper on which recording has been executed is discharged toward a discharge tray 5, provided in the front side of the apparatus, that can assume a stored state (the state illustrated in FIG. 1) and an opened state (not shown).

As shown in FIG. 2, the scanner mechanism portion 3 includes, in its top surface, a document plate glass 7 provided at the base area of a recessed portion 3*a*, and includes the document plate cover 6 (see FIG. 1) that can assume a state in which the document plate glass 7 is covered and a state in which the document plate glass 7 is exposed. Although the top surface of the document plate cover 6 is formed so as to be flush, with no non-planarities, with the top surface of the ink jet complex machine 1 shown in FIG. 1, when the document plate cover 6 is in a closed state, a user can apply his/her finger to the edge of the document plate cover 6 by inserting that finger into a recessed portion 8 formed in the front side of the apparatus and open the document plate cover 6 thereby.

A tilt panel apparatus 10 is provided in the front surface of the apparatus main body of the ink jet complex machine 1. The tilt panel apparatus 10 is configured so as to support a tilt panel 11 in a pivotable state relative to the apparatus main body 1*a* of the ink jet complex machine 1.

The tilt panel 11 includes an information display unit 12, configured of a liquid-crystal monitor, that displays various types of information, such as preview screens, a user interface, and so on, and an operation setting unit 13 having a power button, a recording execution button, an image reading execution button, setting buttons for making various operational settings, and so on; these units are provided in a panel surface 11*a*.

The tilt panel 11 is provided so as to be pivotable central to a pivot axis (not shown), and, by being pivoted, is capable of assuming a first orientation (stored state) illustrated in FIG. 1 and a second orientation (tilted (pivoted) to almost 90°, a state that is indicated by the dot-dot-dash line in FIG. 6). Note that the position of the pivot center of the tilt panel 11 is indicated by the letter C in FIGS. 6 through 8, and a line corresponding to the pivot center is a line that passes through the pivot center C shown in FIGS. 6 through 8 perpendicular to the recording paper.

The tilt panel 11 is capable of being held by an orientation holding member 14 (see FIG. 6) in a tilted state at predetermined angle notches, and thus the user can make various operational settings, visually confirm information, and so on at an angle that is easy for him/her to operate.

As shown in FIG. 6, the orientation holding member 14 is configured so as to include ratchet teeth 14*b* provided in the apparatus main body 1*a* and an engagement claw 14*a* provided in the tilt panel 11. The engagement claw 14*a* is provided in the leading end of a lever member 16 that is in turn provided so as to be capable of swinging in the clockwise/counter-clockwise directions in FIG. 6 central to the pivot axis (not shown), and is capable of engaging with and disengaging from the ratchet teeth 14*b* as the level member 16 swings.

Meanwhile, a release button 15 is provided on the lower side of the lever member 16, and the lever member 16 is provided so as to be biased, by a biasing member (not shown), in the direction in which the engagement claw 14*a* engages with the ratchet teeth 14*b*.

Accordingly, in a state in which the release button 15 is not pressed upwards, the engagement claw 14*a* engages with the ratchet teeth 14*b*, and as a result, the tilt panel 11 does not pivot in the direction that returns the tilt panel 11 to the first orientation (the stored state) (that is, the counter-clockwise direction in FIG. 6), and instead maintains the tilted state. However, when the release button 15 is pressed upwards, the engagement claw 14*a* separates from the ratchet teeth 14*b*, and as a result, the tilt panel 11 can be returned to the first orientation (the stored state). Note that when the tilt panel 11 is tilted from the first orientation (the stored state) to the second orientation (a 90° tilt), the engagement claw 14*a* can move along the ratchet teeth 14*b*, and thus it is not necessary to press the release button 15 upwards.

Here, the release button 15 is provided in the base of the tilt panel 11, on one of the ends in the lengthwise direction (the direction parallel to the pivot center line) of the tilt panel 11. To be more specific, the reference numeral 9 in FIG. 1 indicates a recessed portion formed in the front surface of the ink jet complex machine 1, and the release button 15 is disposed within this recessed portion 9. Accordingly, when the user tilts the tilt panel 11, he/she normally inserts his/her thumb into the recessed portion 9 and applies that thumb to the lower end of the tilt panel 11 (a free-pivoting end), applies his/her index or middle finger to an external housing surface 11*b* (discussed later) on the upper end of the tilt panel 11 (a base side end), and tilts the tilt panel 11.

Note that in FIG. 1, the reference numeral Xa indicates the length of the tilt panel 11 in the width direction (the direction parallel to the pivot center line), whereas the reference numeral Xb indicates the region therein in which the recessed portion 9 is formed, or in other words, the region where the user applies his/her fingers. A regulation portion (stepped portion) 17*b*, which will be described later, is disposed so as to be aligned with this region Xb.

Next, the external housing surface 11*b* of the tilt panel 11 and the regulation portion (stepped portion) 17*b* provided in the apparatus main body 1*a* will be described in detail. A gap indicated by the reference numeral Y2 in FIGS. 7 and 8 is formed between the tilt panel 11 and the apparatus main body 1*a*. It is preferable for this gap Y2 to be formed at as small a size as possible in order to ensure that the apparatus has an attractive appearance, and is thus set to, for example, 1.0 to 3.0 mm (in this embodiment, approximately 1.6 mm when the tilt panel 11 is in the first orientation (the stored state) indicated in FIG. 7).

Meanwhile, the opening of the stated gap Y2 is formed by an edge portion 17*a* of a frame 17 provided in the apparatus main body 1*a* and the external housing surface 11*b* formed central to the pivot center C in the tilt panel 11. The external housing surface 11*b* is exposed on the outer side of the apparatus (the outer side of the gap Y2) when the tilt panel 11 is in the first orientation (the stored state), but, as shown in FIGS. 4 and 6, enters into the interior of the gap Y2 as the tilt panel 11 is pivoted from the first orientation toward the second orientation (a 90° tilt).

In FIGS. 5 and 6, the reference numeral S indicates the region that enters into the gap Y2 as a result of the tilt panel 11 tilting; in this embodiment, the external housing surface indicated by the reference numeral 11*b* refers to the external housing surface formed in this region.

Note that in this embodiment, the housing of the tilt panel 11 is configured of an outer case 18 and an inner case 19, and the external housing surface 11*b* is formed of parts of both. Furthermore, in this embodiment, the external housing surface 11*b* is not at a constant distance from the pivot center C, and thus the gap Y2 changes to a certain extent as a result of the tilt operation of the tilt panel 11. In this embodiment, for reasons related to external appearance and design, the upper end location of the outer case 18 (the location indicated by the reference numeral 18*a* in FIGS. 7 and 8) is the farthest away from the pivot center C, and thus the gap Y2 is smallest when this upper end location 18*a* is opposite from the edge portion 17*a* (basically, the state shown in FIG. 6).

Meanwhile, a stepped shape 17*c* is formed at a location adjacent to the edge portion 17*a* of the frame 17 by the regulation portion (stepped portion) 17*b*, which is a step higher than the edge portion 17*a*, as shown in FIGS. 3 through 8. This regulation portion (stepped portion) 17*b* provides the following effects.

First, when the tilt panel 11 is tilted from the first orientation (the stored state) toward the second orientation (a 90° tilt), the external housing surface 11*b* enters into the gap Y2. Accordingly, if the user has his/her finger (indicated by the reference numeral Fin FIGS. 7 and 8) applied to the external housing surface 11*b*, the pad of the finger F (indicated by the reference numeral Fa in FIG. 7) will also attempt to enter into the gap Y2 as a result of the tilt operations.

At this time, in the case where, for example, the regulation portion (stepped portion) 17*b* is not formed, or in other words, in the case where the edge portion has the shape indicated by the reference numeral E in FIG. 7, it is clear from FIG. 7 that the pad Fa of the finger F will enter into the gap Y2 soon after the tilt operations of the tilt panel 11 have been commenced.

However, because the regulation portion (stepped portion) 17*b* is formed, the pad Fa of the finger F will not enter into the gap Y2 immediately after the tilt operations of the tilt panel 11 have been commenced; instead, before the pad Fa of the finger F enters into the gap Y2, the tip of the finger F makes contact with the regulation portion (stepped portion) 17*b*, as shown in FIG. 8.

In other words, the regulation portion (stepped portion) 17*b* functions as a regulation portion (finger contact portion) that makes contact with the tip of the finger F when the tilt panel 11 is tilted and regulates the movement of the finger F, and thus the unrestricted entry of the pad Fa of the finger F into the gap Y2 can be prevented.

Furthermore, the user's attention can be caught if the finger F makes contact with the regulation portion (stepped portion) 17*b* before the pad Fa of the finger F enters into the gap Y2, making it possible to avoid the possibility of the unrestricted entry of the pad Fa of the finger F into the gap Y2.

Note that in FIGS. 7 and 8, the reference numeral Y1 indicates a space between the regulation portion (stepped portion) 17*b* and the external housing surface 11*b*, and the reference numeral Z1 indicates a step (elevation difference) between the edge portion 17*a* and the regulation portion (stepped portion) 17*b*. This space Y1 and step Z1 can be set as appropriate in accordance with the apparatus configuration, as long as the entry of the pad Fa of the finger F into the gap Y2 can still be prevented. In this embodiment, the space Y1 is set to 3.0 to 5.0 mm (for example, 4.3 mm), whereas the step Z1 is set to 2.0 to 3.0 mm (for example, 2.0 mm).

Here, in addition to being formed so as to prevent the unrestricted entry of the pad Fa of the finger F into the gap Y2, the regulation portion (stepped portion) 17*b* can also be formed so as to completely prevent the pad Fa of the finger F from entering into the gap Y2. Specifically, the configuration can be such that a predetermined distance is secured between the pad Fa of the finger F and the opening of the gap Y2 when the tilt panel 11 is tilted and the tip of the finger F makes contact with the regulation portion (stepped portion) 17*b*. It is desirable for the step Z1 to be as large as possible when the regulation portion (stepped portion) 17*b* is provided with such a function.

Note that the regulation portion (stepped portion) 17*b* according to this embodiment is formed so as to be flush with the upper surface of the frame 17. However, the regulation portion (stepped portion) may be formed as a shape that projects from the upper surface of a frame 17', as indicated by the regulation portion (stepped portion) 17*b*' shown in FIG. 9, and forming the regulation portion (stepped portion) in such a manner makes it possible to configure a larger step Z1 (for example, 4.0 mm).

In addition, as indicated by a frame 17" shown in FIG. 10, forming an inclined surface 17*d* that slants from the apex portion of a regulation portion (stepped portion) 17*b*" toward a position that is lower than the apex portion, in the direction moving away from the external housing surface 11*b*, makes it possible to guide a finger that has made contact with the regulation portion (stepped portion) 17*b*' away from the gap Y2. This makes it possible to prevent, with certainty, the pad of the finger from entering into the gap Y2. Meanwhile, as with the embodiment illustrated in FIG. 9, a greater step Z1 can be secured. Note that the angle of incline $\alpha$ of the inclined surface 17*d* is set to 30° in this embodiment.

Although in the aforementioned embodiments, the regulation portion (stepped portion) 17*b* is disposed so as to be aligned with the region Xb in the direction parallel to the pivot center line of the tilt panel 11 (the lengthwise direction) (in FIG. 1, the location where the release button 15 is provided, or in other words, a location to which it is highly likely that a user will apply his/her finger), it should be noted that the regulation portion (stepped portion) 17*b* can be formed across the entirety of the region Xa in the lengthwise direction.

In addition, although the tilt panel apparatus 10 according to the invention is, in the aforementioned embodiments, applied to an ink jet complex machine 1 serving as an example of a recording apparatus, it goes without saying that the tilt panel apparatus 10 according to the invention can be applied in tilt panels provided in various other types of electronic devices as well.

What is claimed is:

1. A tilt panel apparatus comprising:

a tilt panel capable of pivoting between a first orientation and a second orientation, the tilt panel including an external housing having an external housing surface, wherein the tilt panel is in a stored state in the first orientation and in a tilted state in the second orientation, wherein the external housing includes an outer case composed with an operational panel surface and an inner case on an opposite side of the outer case, wherein the external housing surface has a corner formed by both a portion of the inner case and the outer case; and an apparatus main body that supports the tilt panel in a pivotable state and such that the tilt panel rotates around a pivot center located in an interior of the tilt panel, wherein a gap is formed between a frame of the apparatus main body and the inner case near the corner, wherein an upper area formed by the frame includes a flat portion, and the external housing surface of the tilt panel extends in an upper direction from the flat portion when the tilt panel is in the stored state in the first orientation, with the corner disposed above the gap, wherein the external housing of the tilt panel, including the external housing surface of the tilt panel and the corner, enters the gap when the tilt panel pivots to the second orientation wherein the inner case has an upper end and wherein the external housing surface extends in an upper direction from the flat portion such that the upper end is outside of the gap in the first orientation and such that the upper end enters the gap when the tilt panel pivots to the second orientation.

2. The tilt panel apparatus according to claim 1, wherein an upper area of the external housing surface extends in a direction away from the gap.

3. The tilt panel apparatus according to claim 1, wherein:

a stepped portion is formed in the frame adjacent to an edge portion of the frame, wherein the stepped portion is located such that a finger applied to the external housing surface makes contact with the stepped portion before the finger enters into the gap, and an inclined surface that slants from an apex portion of the stepped portion toward a position that is lower than the apex portion, in the direction moving away from the external housing surface, is formed in the frame.

4. An electronic device comprising the tilt panel apparatus according to claim 1.

5. The tilt panel apparatus of claim 1, wherein the frame includes an edge portion and a stepped portion, wherein the stepped portion is adjacent to the edge portion and rises to the flat portion, wherein the gap is formed between the edge portion and the external housing surface of the tilt panel.

6. The tilt panel apparatus of claim 5, wherein an apex of the stepped portion is further from the external housing than the edge portion.

7. The tilt panel apparatus of claim 5, further comprising a pivot center, wherein a distance between the pivot center and the external housing surface is not constant.

8. The tilt panel apparatus of claim 7, wherein the gap narrows as the tilt panel pivots from the first orientation to the second orientation.

9. The tilt panel apparatus of claim 1, wherein the external housing surface is exposed in the first orientation and wherein the external housing surface enters into the gap in the second orientation.

10. The tilt panel apparatus of claim 1, wherein the external housing surface moves closer to the apparatus main body when the tilt panel moves from the first orientation to the second orientation.

11. A tilt panel apparatus comprising:

a tilt panel capable of pivoting between a first orientation and a second orientation, the tilt panel having an external housing surface that includes a corner formed by a portion of both an inner case and an outer case, wherein the tilt panel is in a stored state in the first orientation and in a tilted state in the second orientation, wherein the outer case is composed with an operational panel surface and the inner case is on an opposite side of the outer case; and an apparatus main body that supports the tilt panel in a pivotable state around a pivot center that is inside the tilt panel, wherein the tilt panel includes the external housing surface around the pivot center of the tilt panel such that the tilt panel rotates around the pivot center, the external housing surface of the tilt panel being exposed on an outer side of an apparatus when the tilt panel is in the first orientation and the corner of the exposed external housing surface moving from a location outside of to entering into a gap formed between the inner case of the tilt panel and the apparatus main body as the tilt panel pivots from the first orientation toward the second orientation; and a finger contact portion is included in the apparatus main body adjacent to an edge portion that forms the opening of the gap, the finger contact portion securing a distance between the pad of a finger and the opening by making contact with the tip of the finger when the tilt panel is pivoted from the first orientation toward the second orientation in a state in which the finger is applied to the external housing surface, wherein the external housing surface, including the corner, extends in an upward direction from a flat portion adjacent the finger contact portion and the gap when the tilt panel is in the stored state in the first orientation, and wherein the corner of the tilt panel, including the external housing surface of the tilt panel, enters the gap when the tilt panel pivots to the second orientation.

12. A tilt panel apparatus comprising:

a tilt panel capable of pivoting between a first orientation and a second orientation, the tilt panel having an external housing surface that includes a corner formed by a portion of both an inner case and an outer case, wherein the inner case has an upper end, wherein the tilt panel is in a stored state in the first orientation and in a tilted state in the second orientation, wherein the outer case is composed with an operational panel surface and the inner case is on an opposite side of the outer case; and an apparatus main body that supports the tilt panel in a pivotable state, wherein the tilt panel includes the external housing surface around a pivot center of the tilt panel, wherein the pivot center is located inside the tilt panel such that the tilt panel rotates around the pivot center, the external housing surface of the tilt panel, including the corner, being exposed on the outer side of an apparatus when the tilt panel is in the first orientation and the corner of the exposed external housing surface moving from a location outside of to entering into a gap formed between the inner case of the tilt panel and the apparatus main body as the tilt panel pivots from the first orientation toward the second orientation; and a regulation portion is included in the apparatus main body adjacent to an edge portion that forms the opening of the gap, the regulation portion regulating the movement of a finger by making contact with the tip of the finger when the tilt panel is pivoted from the first orientation toward the second orientation in a state in which the finger is applied to the external housing surface, wherein the external housing surface, including the corner, extends in an upward direction from a flat portion adjacent the finger contact portion and the gap when the tilt panel is in the stored state in the first orientation, and wherein the corner of the tilt panel, including the external housing surface of the tilt panel, enters the gap when the tilt panel pivots to the second orientation.

* * * * *